US007815295B2

(12) United States Patent
Takemoto

(10) Patent No.: US 7,815,295 B2
(45) Date of Patent: Oct. 19, 2010

(54) LIQUID DISCHARGE DEVICE

(75) Inventor: Takatoshi Takemoto, Nagoya (JP)

(73) Assignee: Brother Kogyo Kabushiki Kaisha, Aichi-ken (JP)

( * ) Notice: Subject to any disclaimer, the term of this patent is extended or adjusted under 35 U.S.C. 154(b) by 761 days.

(21) Appl. No.: 11/824,117

(22) Filed: Jun. 29, 2007

(65) Prior Publication Data

US 2008/0001978 A1 Jan. 3, 2008

(30) Foreign Application Priority Data

Jun. 30, 2006 (JP) ..... 2006-181777

(51) Int. Cl.
*B41J 2/17* (2006.01)
*B41J 2/175* (2006.01)
*B41J 2/195* (2006.01)
*B41J 29/38* (2006.01)

(52) U.S. Cl. ..... 347/85; 347/84; 347/86; 347/7; 347/17

(58) Field of Classification Search ..... 347/85, 347/84, 86, 7, 17, 87, 40, 19
See application file for complete search history.

(56) References Cited

U.S. PATENT DOCUMENTS 6,068,370 A * 5/2000 Miller et al. ..... 347/85
6,234,615 B1 5/2001 Tsukuda
6,276,784 B1 * 8/2001 Ikkatai et al. ..... 347/85
6,783,215 B2 * 8/2004 Yoshida et al. ..... 347/85
6,799,840 B2 * 10/2004 Inamura ..... 347/85
6,846,072 B2 * 1/2005 Sato et al. ..... 347/86
6,866,372 B2 3/2005 Oda et al.

(Continued)

FOREIGN PATENT DOCUMENTS

JP 04358844 A * 12/1992

(Continued)

OTHER PUBLICATIONS

Machine Translation for Nishino (JP Pat 2004195929 A)—obtained from (http://www19.ipdl.inpit.go.jp/PA1/cgi-bin/PA1INIT?1273352423836).*

*Primary Examiner*—Stephen D Meier
*Assistant Examiner*—Leonard S Liang
(74) *Attorney, Agent, or Firm*—Frommer Lawrence & Haug LLP

(57) ABSTRACT

A liquid discharge device includes a casing, a carriage, a discharge head, a sub tank, an energy supply device, and a controller. The casing has a space for housing a main tank. The carriage is capable of moving. The discharge head is arranged on the carriage. The sub tank is arranged on the carriage. The sub tank communicates with the discharge head. The sub tank is connected with the main tank when the carriage is located at a predetermined position. The sub tank is disconnected with the main tank when the carriage is located at positions other than the predetermined position. The energy supply device supplies energy to liquid within the main tank such that the liquid within the main tank is discharged. The controller controls the energy supply device such that the ink within the main tank is supplied to the sub tank when the carriage is located at the predetermined position. The controller controls the energy supply device such that the liquid within the main tank is discharged before the carriage arrives at the predetermined position.

15 Claims, 9 Drawing Sheets

U.S. PATENT DOCUMENTS

| | | | | |
|---|---|---|---|---|
| 7,290,849 | B2 * | 11/2007 | Yamazaki et al. | 347/19 |
| 7,407,241 | B2 * | 8/2008 | Mutoh et al. | 347/5 |
| 7,748,831 | B2 | 7/2010 | Umeda | |
| 2001/0038405 | A1 * | 11/2001 | Ishizawa et al. | 347/86 |
| 2002/0075364 | A1 * | 6/2002 | Takahashi et al. | 347/85 |
| 2003/0063167 | A1 * | 4/2003 | Yoshida et al. | 347/85 |
| 2003/0160848 | A1 * | 8/2003 | Taniguchi et al. | 347/86 |
| 2003/0202059 | A1 * | 10/2003 | Kimura et al. | 347/85 |
| 2004/0160496 | A1 * | 8/2004 | Tsurui et al. | 347/86 |
| 2004/0189753 | A1 * | 9/2004 | Ikezaki | 347/85 |
| 2005/0024397 | A1 * | 2/2005 | Mizoguchi | 347/7 |
| 2006/0274096 | A1 * | 12/2006 | Kanda et al. | 347/14 |

FOREIGN PATENT DOCUMENTS

| | | | |
|---|---|---|---|
| JP | 11207988 | | 8/1999 |
| JP | 2001058415 | | 3/2001 |
| JP | 2001162830 | | 6/2001 |
| JP | 2001219570 | A * | 8/2001 |
| JP | 2002347258 | | 12/2002 |
| JP | 2003175632 | | 6/2003 |
| JP | 2004195929 | A * | 7/2004 |
| JP | 2004284193 | | 10/2004 |

* cited by examiner

LIQUID DISCHARGE DEVICE

CROSS-REFERENCE TO RELATED APPLICATION

This application claims priority to Japanese Patent Application No. 2006-181777, filed on Jun. 30, 2006, the contents of which are hereby incorporated by reference into the present application.

BACKGROUND OF THE INVENTION

1. Field of the Invention

The present invention relates to a liquid discharge device that discharges liquid from a main tank to a sub tank that is arranged on a carriage.

2. Description of the Related Art

Ink jet printers having a so-called stationary supply mechanism are known. With the stationary supply mechanism, a sub tank that is capable of storing a small amount of ink is arranged on a carriage. A print head used to print on a printing medium is also arranged on the carriage. Ink is supplied to the print head from the sub tank. A main tank that is capable of storing a large amount of ink is attached to a position separate from the carriage. The carriage is capable of moving. When the carriage is located at an ink supply position, the sub tank and the main tank are temporarily connected, for instance, with a supply nozzle, and ink is replenished from the main tank to the sub tank.

In the case of ink jet printers using the stationary supply mechanism, impurities such as dust or dried ink may adhere to the distal end of the supply nozzle. In this case, the impurities may be transferred into the sub tank in the course of connecting the supply nozzle to the sub tank. Moreover, there is a substantial possibility that the impurities adhered to the inside of the distal end of the supply nozzle will be transferred into the sub tank.

Once such impurities are transferred into the sub tank, it is almost impossible to remove them from the sub tank. Such impurities give rise to undesirable conditions such as clogging of a filter inside the sub tank. Also, with impurities inside the supply nozzle, efficiency of ink replenishment is hindered. For example, in the case of detecting the amount of ink inside the sub tank with a sensor, if ink cannot be replenished efficiently, a longer time period is needed for the replenishing process. Furthermore, in the case of replenishing ink using a timer, necessary amount of ink may not be supplied to the sub tank within the allowed time period.

The Japanese Patent Application Publication No. 2001-162830 discloses an ink jet printer having a cleaning device for removing impurities adhering to a supply nozzle of a main tank. The supply nozzle is supported by a rotatable supporting stand. The supply nozzle can be rotated to face a sub tank and be inserted into the sub tank to replenish ink to the sub tank. The supply nozzle and its supporting stand can be rotated to face the cleaning device, and moved to insert the supply nozzle therein. Then, the impurities adhering to the supply nozzle is brushed off with a brush of the cleaning device. In this technique, a process of cleaning the supply nozzle is performed during a stand-by status.

BRIEF SUMMARY OF THE INVENTION

In the above-mentioned document, a timing at which the cleaning process is performed is not clearly described. The present specification discloses a technique which is capable of performing a cleaning process at a suitable timing. This technique may achieve a reduction in the time required for supplying liquid within a main tank to a sub tank while preventing impurities from transferring into the sub tank from the main tank.

A liquid discharge device disclosed in the present specification includes a casing, a carriage, a discharge head, a sub tank, an energy supply device, and a controller. The casing has a space for housing a main tank. The carriage is capable of moving. The discharge head is arranged on the carriage. The sub tank is arranged on the carriage. The sub tank communicates with the discharge head. The sub tank is connected with the main tank when the carriage is located at a predetermined position. The sub tank is disconnected with the main tank when the carriage is located at positions other than the predetermined position. The energy supply device supplies energy to liquid within the main tank such that the liquid within the main tank is discharged. The controller controls the energy supply device such that the liquid within the main tank is supplied to the sub tank when the carriage is located at the predetermined position. The controller controls the energy supply device such that the liquid within the main tank is discharged before the carriage arrives at the predetermined position.

With the aforementioned configuration, a discharging of liquid (hereinafter, this discharging is termed preliminary discharge) is performed before the carriage arrives at the predetermined position (an liquid supply position) and the sub tank is connected with the main tank. By performing the preliminary discharge, impurities adhering to the main tank will be removed. This can prevent the impurities from transferring into the sub tank. The preliminary discharge is completed by the time at which the carriage reaches the liquid supply position. The sub tank and the main tank can thus be connected right after the carriage reaches the liquid supply position, and begin the replenishment of liquid. A reduction in the time required for replenishing liquid within the main tank to the sub tank is achieved.

DETAILED DESCRIPTION OF THE INVENTION

Figure 1:
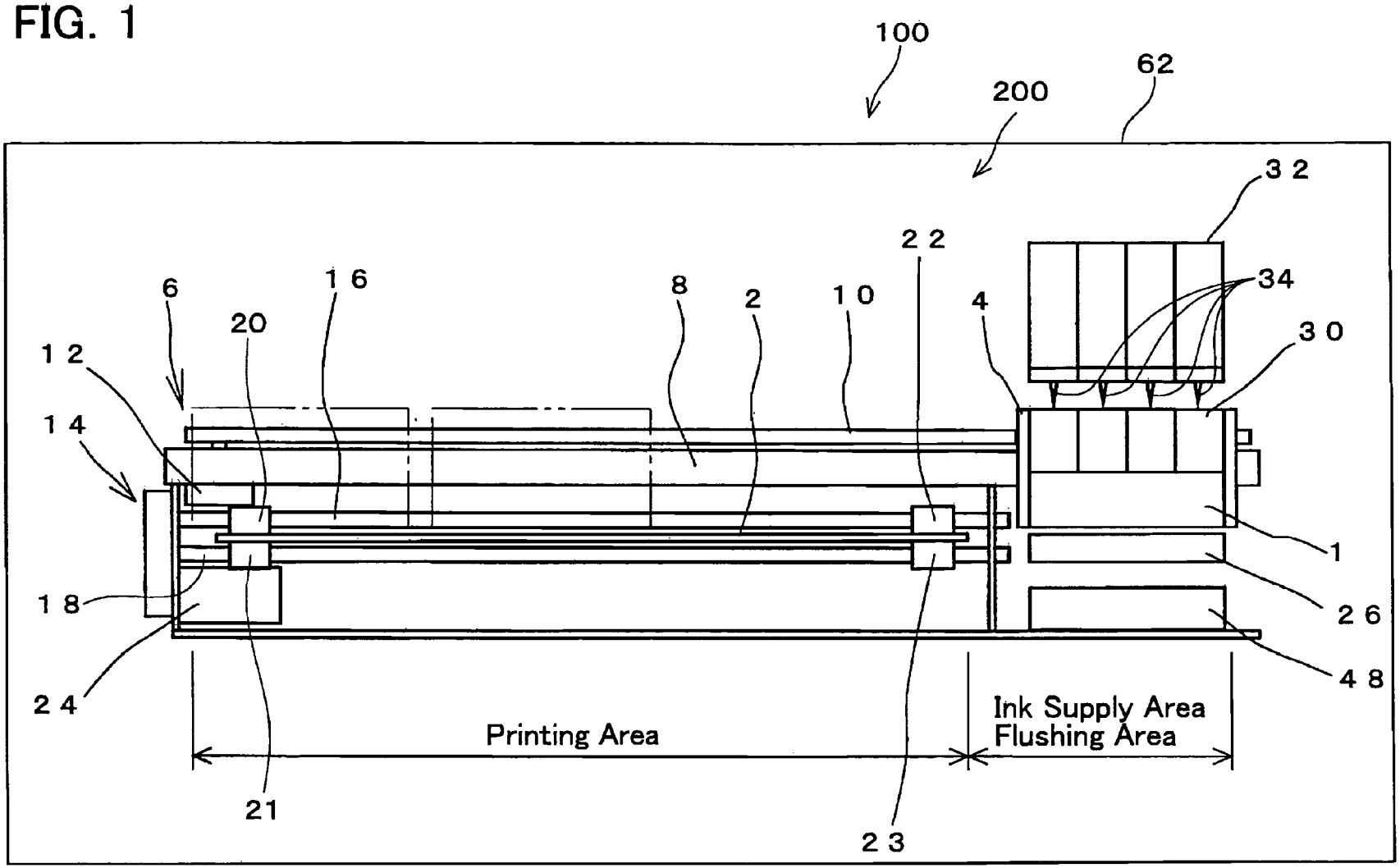
FIG. 1 shows a schematic plan view of an ink jet printer utilizing an ink supply device.

FIG. 1 shows a schematic plan view of an ink jet printer 100 utilizing an ink supply device 200. The ink jet printer 100 has a casing 62 that houses the ink supply device 200, which comprises the components as described below. Within the casing 62, the ink supply device 200 has a print head 1, which is of an ink jet type. The print head 1 utilizes piezoelectric elements or thermoelectric elements to discharge ink drops onto the printing medium 2 that is fed underneath the print head 1. An image is printed on the printing medium 2, such as a paper, in accordance with data input to the ink jet printer 100.

The print head 1 is mounted onto a carriage 4. The carriage 4 is moved using a carriage driving mechanism 6. The carriage driving mechanism 6 includes a timing belt 10 that is arranged along a guide member 8. The timing belt 10 is connected to the carriage 4, and is driven by a motor 12 arranged on the guide member 8. The driving force of the motor 12 is exerted on the timing belt 10, and rotates the timing belt 10. The carriage 4 can thus be moved back and forth along the guide member 8. Moreover, a sub tank 30 is also mounted on the carriage 4 with the print head 1. The sub tank 30 stores ink inside, and provides the ink to the print head 1.

The printing medium 2 is fed by a paper feeding mechanism 14 in a perpendicular direction to the moving direction of the carriage 4. The paper feeding mechanism 14 includes roller shafts 16, 18 that are arranged parallel to the guide member 8. Two pairs of supply rollers 20, 21 and 22, 23 are arranged on the roller shafts 16, 18 in such a manner that the printing medium 2 can be caught and fed between the supply rollers 20 and 21, and also between the supply rollers 22 and 23. In the course of sending the printing medium 2 through the paper feeding mechanism 14, the roller shafts 16, 18 are rotated by a feeding motor 24.

The carriage 4 is moved by the carriage driving mechanism 6 in its moving direction, through a printing area and an ink supply area. The ink supply area is arranged on one side of the printing area, which is an area the printing medium 2 occupy during the printing process. Within the ink supply area, ink is replenished to the sub tank 30. Moreover, the ink supply area also serves as a flushing area. With such configuration, the space required for a flushing area can be abbreviated. The construction of the ink jet printer 100 can be simplified, and the size of the ink jet printer 100 can be compact. When the carriage 4 is moved into the flushing area, a compulsory flushing of ink from the print head 1 is processed.

When the carriage 4 is in the ink supply area, or, the flushing area, the print head 1 is also outside the printing area. Even when ink is discharged within such area, the printing medium 2 is not within the marking range of the ink.

When data to process printing is input to the ink jet printer 100 and printing process is performed, the carriage 4 moves within the printing area. The carriage 4 is at its printing position during printing, and the print head 1 discharges ink onto the printing medium 2 in accordance with the printing data. The carriage 4 moves to the ink supply area when replenishing ink to the sub tank 30.

In the ink supply area, a cap 26 is arranged. The cap 26 covers a nozzle surface (not shown in the figures) of the print head 1, to prevent the ink inside the print head 1 from drying when the carriage 4 is in the ink supply area. The cap 26 can be moved by a moving mechanism, not shown in the figures, between a sealing position and a stand-by position. The cap 26 covers the nozzle surface (discharge nozzles) in the sealing position, and when the cap 26 is retracted lower with respect to the print head 1 to the stand-by position, it is separated from the print head 1.

In the ink supply area, a main tank 32 is detachably housed in the casing 62. The main tank 32 is houses separately from the sub tank 30. The main tank 32 is communicated with a supply nozzle 34 when it is set at a predetermined position within the casing 62. When the carriage 4 moves into the ink supply area and stops at a predetermined ink supply position, the sub tank 30 and the main tank 32 are temporarily connected, and the ink inside the main tank 32 is replenished to the sub tank 30 via the supply nozzle 34. In the ink supply area, a foam 48 is also arranged under the supply nozzle 34. The foam 48 is arranged at a position where the ink discharged from the supply nozzle 34 drips. In the case when the cap 26 is in its stand-by position and the carriage 4 is not within the ink supply area, the ink discharged from supply nozzle 34 falls onto the foam 48 placed below.

Figure 2:
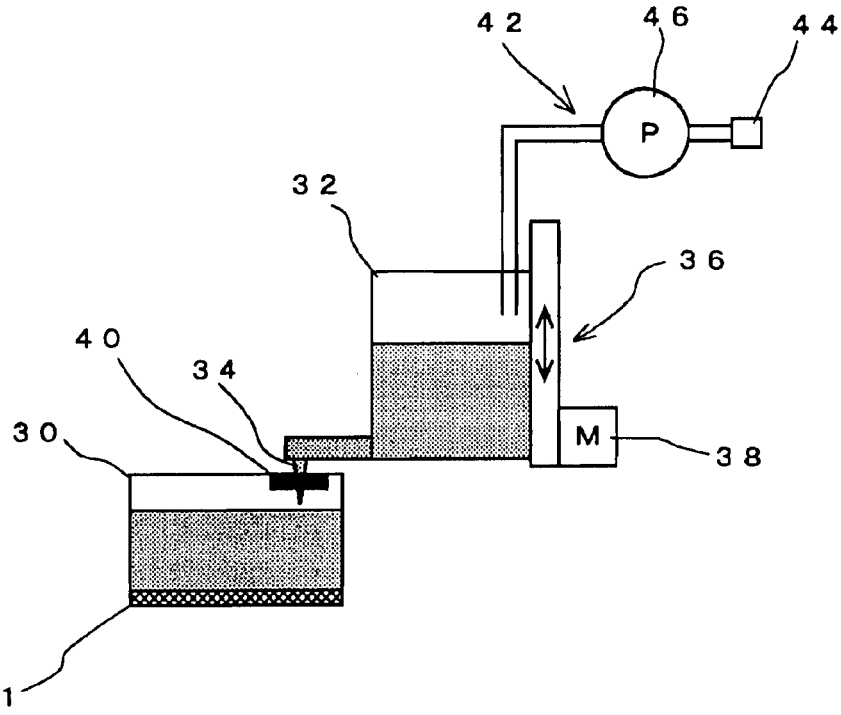
FIG. 2 shows a schematic view of the ink supply device with the sub tank and the supply nozzle in a connected state.
Figure 3:
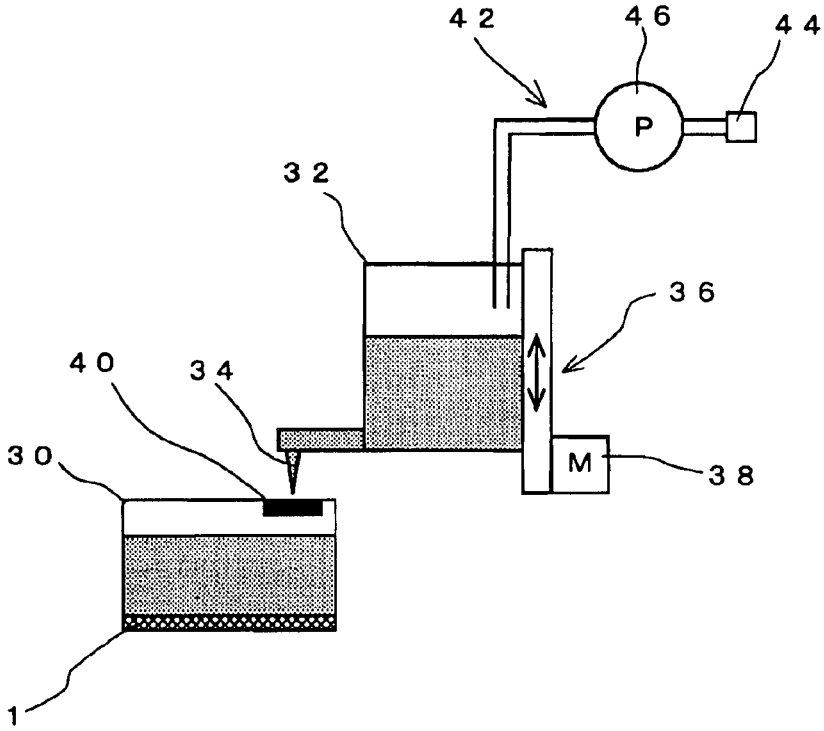
FIG. 3 shows a schematic view of the ink supply device with the sub tank and the supply nozzle in a disconnected state.
Figure 4:
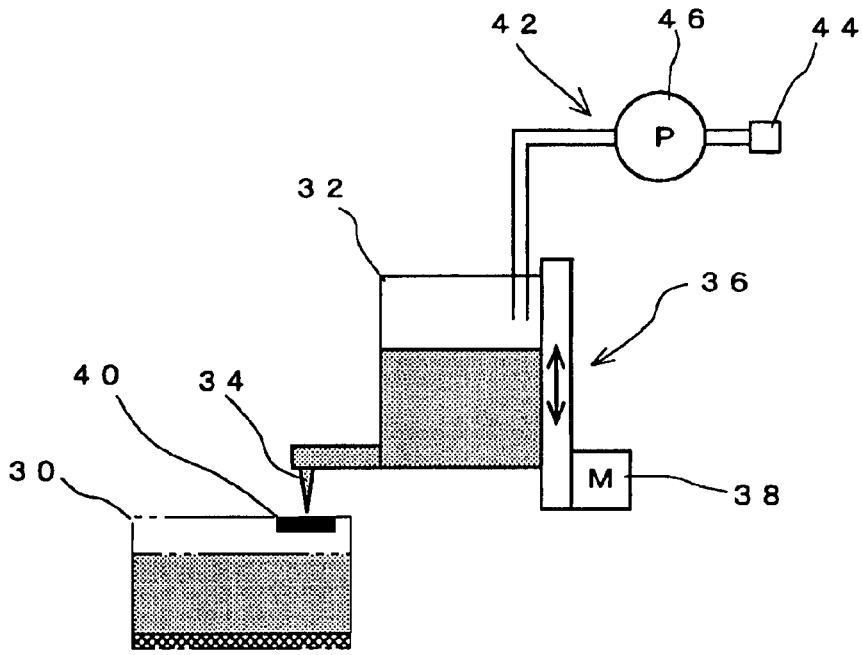
FIG. 4 shows a schematic view of the ink supply device with the carriage in the printing area.
Figure 5:
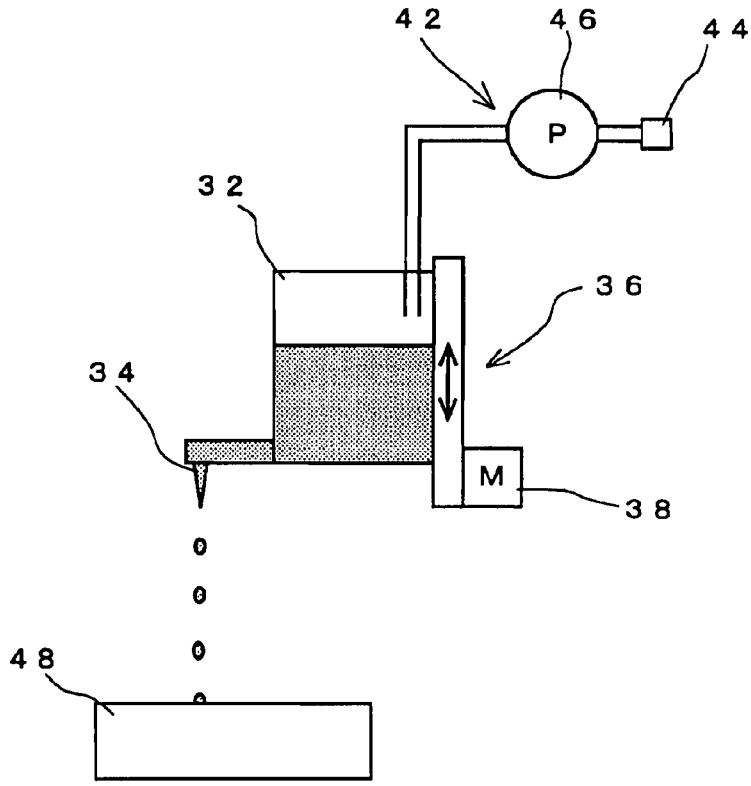
FIG. 5 shows a schematic view of the ink supply device performing a preliminary discharging.
Figure 6:
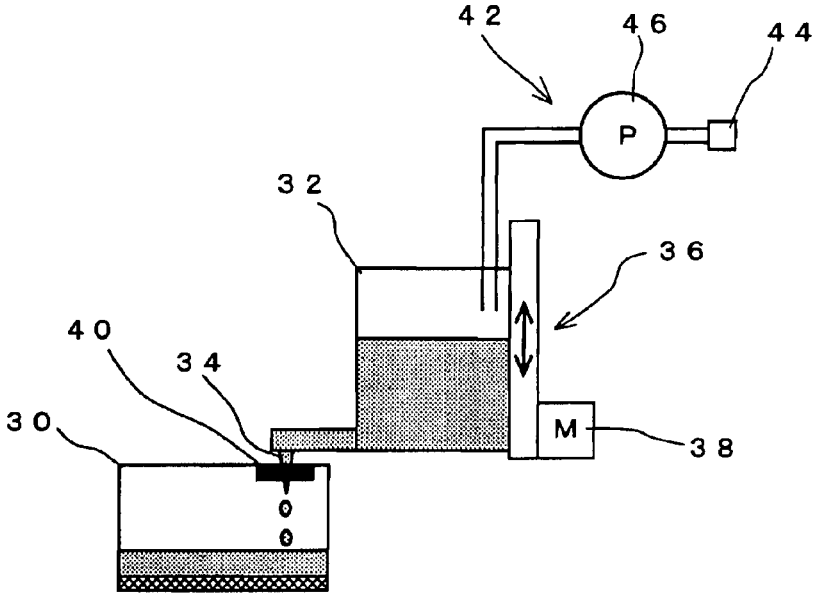
FIG. 6 shows a schematic view of the ink supply device replenishing ink to a sub tank.

FIG. 2 shows a schematic view of the ink supply device 200 with the sub tank 30 and the supply nozzle 34 in a connected state. FIG. 3 shows a schematic view of the ink supply device 200 with the sub tank 30 and the supply nozzle 34 in a disconnected state. FIG. 4 shows a schematic view of the ink supply device 200 with the carriage 4 in the printing area. FIG. 5 shows a schematic view of the ink supply device 200 performing preliminary discharge. FIG. 6 shows a schematic view of the ink supply device 200 and its ink replenishing state. The print head 1 and sub tank 30 in FIG. 4 are shown with dotted lines, to accentuate that the carriage 4 is in the printing area in FIG. 4.

As shown in FIG. 2, in the present embodiment, a connecting mechanism 36 is arranged to move the supply nozzle 34 and the main tank 32 so that the supply nozzle 34 is inserted into the sub tank 30. The connecting mechanism 36 is driven by a motor 38, and moves the main tank 32 and the supply nozzle 34 in the up and down direction, that is, the direction orthogonal to the printing surface of the printing medium 2. As shown in FIG. 2 and FIG. 6, with the aforementioned connecting mechanism 36, the supply nozzle 34 is moved downward. With the carriage 4 at the ink supply position, the supply nozzle pierces through a seal member 40.

The seal member 40 is coupled to the sub tank 30 to cover a connecting hole (not shown in the figures) that is formed on the sub tank 30. The seal member 40 is made of elastomeric material or the like, and it is arranged to cover the connecting hole of the sub tank 30. When the carriage 4 is at the ink supply position within the ink supply area, the supply nozzle 34 can be lowered so as to pierce through the seal member 40 and into the corresponding connecting hole by the connecting mechanism 36. As a result of the lowering movement, the supply nozzle 34 is inserted into the sub tank 30, and the supply nozzle 34 and the sub tank 30 are connected.

Furthermore, by moving the supply nozzle 34 in the upward direction using the connecting mechanism 36, the supply nozzle 34 is pulled out from the seal member 40, and the supply nozzle 34 and the sub tank 30 are disconnected, while, simultaneously, the hole pierced through the seal member 40, by the supply nozzle 34, is clogged by the restoration force of the elastomeric material, thus sealing the sub tank 30. The transfer of dust therethrough and the drying of ink are inhibited.

In the present embodiment, the connecting mechanism 36 moves the main tank 32 and the supply nozzle 34 in the up and down direction to connect or disconnect the supply nozzle 34 and the sub tank 30. However, the connecting mechanism 36 is not restricted to such construction. For example, the main tank 32 and the supply nozzle 34 can be connected by an elastic tube or the like, and the connecting mechanism 36 may only move the supply nozzle 34. Moreover, the connecting mechanism 36 may move the supply nozzle 34 in a rotating direction rather than in a straight direction. In this case, the supply nozzle 34 can be swung around a shaft pin arranged at its rotating center to connect and disconnect with the sub tank 30. Furthermore, the supply nozzle 34 can be moved in a horizontal direction or the left-right direction, or in an angled direction. In all of the aforementioned cases, the connecting mechanism 36 is able to connect and disconnect the supply nozzle 34 and the sub tank 30.

Furthermore, a cover member may be movably connected to the sub tank 30 to cover the connecting hole thereof. In such case, the supply nozzle 34 does not need to pierce through the seal member 40. The connecting hole may be sealed, by fixing the cover member with a spring that exerts a force in the sealing direction or the closing direction, and the supply nozzle 34 may move the cover member towards the opening direction and work against the force exerted by the spring. Even with the aforementioned construction, the connecting mechanism 36 is capable of connecting the supply nozzle 34 and the sub tank 30.

Furthermore, a pump mechanism 42 is arranged to supply energy to the ink inside the main tank 32. The pump mechanism 42 includes a filter 44, and a pump 46. The pump mechanism 42 draws in air through the filter 44, which is compressed and driven into the main tank 32 by the pump 46. When the compressed air is pumped into the main tank 32, according amount of ink stored inside the main tank 32 is discharged from the supply nozzle 34. The pump mechanism 42 is not restricted to the aforementioned construction. For example, a pump may be arranged at the ink passage between the main tank 32 and the supply nozzle 34, and compress the ink thereof. Furthermore, the device that supplies energy to the ink inside the main tank 32 may include constructions other than the pump mechanism 42.

The sub tank 30 and the main tank 32 may each distinctively store ink of plurality of colors: cyan, yellow, magenta, and black. The tanks of the aforementioned colors of ink may be formed as one component, or the colored ink may be stored in separate tanks. In the present embodiment, one set of the supply nozzle 34 and the pump mechanism 42 is arranged for each of the colored ink. The connecting mechanism 36 and the connecting position adjusting mechanism 41 may move the sets for the aforementioned four types of colored ink simultaneously in the same direction. Furthermore, the aforementioned sets may also be moved separately.

Figure 7:
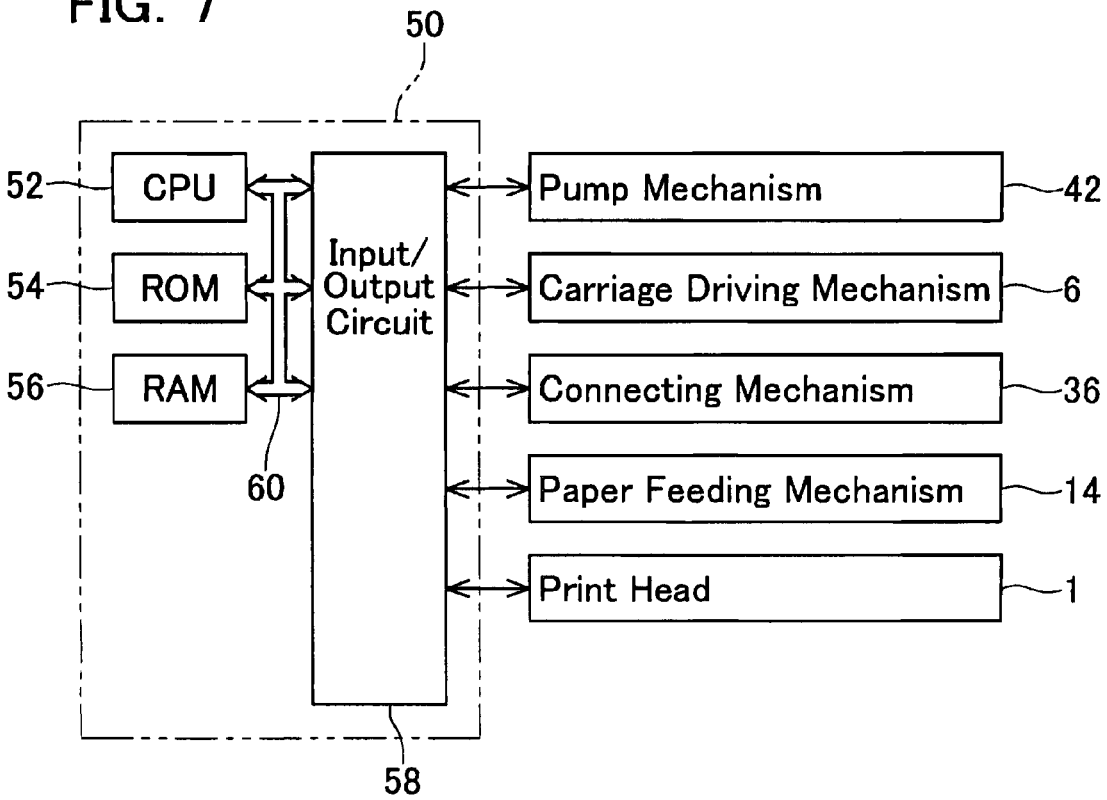
FIG. 7 shows a schematic view of the electrical system of the ink jet printer.

FIG. 7 shows a schematic view of the electrical system of the ink jet printer 100. As shown in FIG. 7, the aforementioned print head 1, carriage driving mechanism 6, paper feeding mechanism 14, connecting mechanism 36, and pump mechanism 42 are connected to a controller 50. The controller 50 includes a CPU 52, a ROM 54 and a RAM 56 as the main components of the logic operation circuit. The aforementioned components of the logic operation circuit are connected to an input/output circuit 58 via a common bus 60. The input/output circuit 58 inputs signal from and outputs signal to the exterior mechanisms connected thereof.

The CPU 52 controls the print head 1, carriage driving mechanism 6 and paper feeding mechanism 14 via the input/output circuit 58 so that the carriage 4 is moved back and forth in the moving direction while the print head 1 discharges ink onto the printing medium 2 that is fed into the printing area. Furthermore, the CPU 52 also controls the carriage driving mechanism 6, the connecting mechanism 36, and the pump mechanism 42 in order to replenish ink to the sub tank 30. These controls are operated according to the data and control program stored in the ROM 54 and RAM 56.

FIG. 8 shows a flow chart of the replenishing process. As shown in FIG. 8, when the replenishing process is carried out, whether or not a printing signal has been input is determined (S100). If the printing signal is not input ("NO" in S100), the controller 50 maintains the stand-by status until such signal is input. In the present embodiment, during the stand-by status, the carriage 4 is at its ink supply position within the ink supply area, and the cap 26 is at the sealing position and as such sealing the discharge nozzles of the print head 1. Furthermore, the sub tank 30 and the supply nozzle 34 are connected during the stand-by status (see FIG. 2). With such a configuration, the adhesion of impurities such as dust and drying of ink within the supply nozzle 34 are prevented.

When the printing signal is input ("YES" in S100), the connecting mechanism 36 is controlled so that the main tank 30 and the supply nozzle 34 are moved upward, and the supply nozzle 34 and the sub tank 30 are disconnected as shown in FIG. 3 (S110). Along with the above mentioned disconnection, the cap 26 is moved from the sealing position to the stand-by position.

Then, as shown in FIG. 4, the print head 1, carriage driving mechanism 6 and paper feeding mechanism 14 are controlled so that the carriage 4 is moved to the printing area to begin the printing process (S120). In accordance with the printing data, the carriage 4 moves back and forth as ink is discharged from the print head 1, while the printing medium 2 is fed through the printing area.

Next, it is determined if the time period, for which the supply nozzle 34 and the sub tank 30 have been disconnected, is within a predetermined time limit (S130). When the supply nozzle 34 is disconnected from the sub tank 30, the supply nozzle 34 is exposed to air. The ink inside the distal end of each supply nozzle 30 is in a condition in which the ink is likely to dehydrate. However, at the beginning of the printing process, for example, the disconnection time period is within the predetermined time limit ("YES" in S130).

Then, whether or not the sub tank 30 needs ink replenishment is determined (S140). This determination can be done, for example, based on the data detected by an ink remainder sensor (not shown in the figures) arranged on the sub tank 30. The ink remainder sensor detects the amount of ink remaining inside the sub tank 30. The remaining amount of ink can also be calculated from the ink consumption according to the printing data. In this step, it is determined whether the amount of ink inside the sub tank 30 is less than the predetermined limit amount, and if replenishment of ink is necessary. At the beginning of the printing process, for example, there is plenty of ink inside each of the sub tanks 30, so it will be determined that replenishment of ink is unnecessary ("NO" in S140).

Then, it is determined whether or not the printing data has been completely printed and the printing has been completed (S240). If printing has not been completed ("NO" in S240), steps of S130, S140 and S240 are repeatedly performed, and depending on the determination of the aforementioned steps, other necessary steps as will be described below are performed.

In the case where the disconnection time exceeds the predetermined time limit ("NO" in S130) during the process of repeating the steps of S130, S140 and S240 while the printing of the printing data is still continuing, the ink inside the supply nozzle 34 can potentially dehydrate. Hence, the pump mechanism 42 is controlled so that the pump 46 drives air into the main tank 32, and preliminary ink discharge is executed (S135). The air driven into the main tank 32 compels the ink to discharge from the supply nozzle 34. Thus, impurities that had adhered inside the supply nozzle 34, such as the drying ink and dust, are washed off along with the ink liquid that is discharged by the process of step S135 (see FIG. 6). In this step, the ink inside the supply nozzle 34 is preliminarily discharged before the supply nozzle 34 is connected to the sub tank 30. Thus, the transfer of such impurities into the sub tank 30 is prevented.

When the above-mentioned process of the step S135 is carried out, the carriage 4 is in the printing area, as shown in FIG. 4. Therefore, the ink drips and impurities (if any) that are discharged by the preliminary ink discharge motion fall onto the foam 48 that is placed under the main tank 32, and absorbed therein (see FIG. 5). The ink discharged in the preliminary discharge from the supply nozzle 34 will not contaminate the sub tank 30 and the print head 1. It is also possible to strain the ink absorbed by the foam 48 by using filters, and return it to the main tank 32. Furthermore, when the print head 1 is processing printing, the cap 26 is in its stand-by position. Therefore, the cap 26 will likewise not be contaminated by the ink discharged in the preliminary ink discharge. It is also possible to strain the ink absorbed by the foam 48 by using filters, and return it to the main tank 32.

Not much ink needs to be discharged in the step S135. The amount of ink only needs to be sufficient enough to wash out the impurities that may exist in the distal end of the supply nozzle 34. When the process of step S135 is carried out, as shown in FIG. 4, the printing process is still continuing. Thus, the print head 1 and the sub tank 30 are mounted on the carriage 4, hence moving with the carriage 4 within the printing area. The ink discharged in the preliminary ink discharge from the supply nozzle 34 will not contaminate the sub tank 30 and the print head 1, for the discharge is taking place within the ink supply area.

After executing the preliminary ink discharge process of step S135, and if the remaining ink inside the sub tank 30 is less than the predetermined limit, and it was determined that the replenishment of ink is necessary ("YES" in S140) during the process of repeating the steps of S130, S140 and S240, and the printing process is still continuing, a preliminary ink discharge is executed (S150). As in the process of step S135, the pump mechanism 42 is controlled so that air is driven into the main tank 32 via the pump 46, and the ink is preliminarily discharged from the main tank 32. During the process, the carriage 4 is still printing within the printing area, so the ink discharged in the process of step S150 falls onto the foam 48 and absorbed therein (see FIG. 5). A time for cleaning the supply nozzle 34 can concurrently be done while the ink jet printer 100 is performing other processes.

Then, the printing motion of the print head 1 is temporarily stopped, and the printing process is paused (S160). The carriage driving mechanism 6 is controlled in order to move the carriage 4 to the ink supply position within the ink supply area (S170). Then, the connecting mechanism 36 is controlled in order to drive the motor 38 to move the supply nozzle 34 downward. As shown in FIG. 2, the sub tank 30, which is now at the ink supply position within the ink supply area, is connected to the supply nozzle 34 (S180).

After the sub tank 30 and the supply nozzle 34 are connected in the process of step S180, the pump mechanism 42 is controlled in order to replenish ink into the sub tank 30 (S190). The pump 46 is driven so that air is driven into the main tank 32. As shown in FIG. 6, the air driven into the main tank 32 forces the ink therein to be discharged from the supply nozzle 34, and the ink is replenished into the sub tank 30.

During the aforementioned process of step S150, before the supply nozzle 34 is connected to the sub tank 30, the impurities such as dried ink and dust are washed out of the supply nozzle 34 with ink. The transfer of impurities into the sub tank 30 is hence prevented. When the process of step S150 is carried out, the print head 1 and the sub tank 30 are located within the printing area. The ink discharged in the above mentioned preliminary ink discharge from the supply nozzle 34 occurs within the ink supply area, and the sub tank 30 and the print head 1 will not be contaminated. The supply nozzle 34 and the sub tank 30 can be connected just after the carriage 4 stops at the ink supply position, and ink can be replenished directly afterwards. The time required for ink replenishment can be shortened.

Then, it is determined if the sub tank 30 has been replenished with the necessary amount of ink (S200). If the sub tank 30 is not replenished sufficiently ("NO" in S200), the process of step S190 is continued and the pump 46 is driven until the sub tank 30 is replenished with the necessary amount of ink.

In the case where a sensor is used to detect the amount of ink inside the sub tank 30, the above-mentioned determination for step S200 can be done based on the amount of ink detected by the sensor. Furthermore, the amount of ink replenished into the sub tank 30 is determined by the driving rate of the pump 46, hence the determination for step S200 can also be done by detecting the driving rate of the pump 46.

When the sub tank 30 is replenished with the necessary amount of ink ("YES" in S200), the driving of the pump 46 is ceased (S210). Then, the connecting mechanism 36 is controlled in order to drive the motor 38 so that the supply nozzle 34 is moved upward so as to disconnect the supply nozzle 34 from the sub tank (S220). As a result, the supply nozzle 34 is withdrawn from the seal member 40 of the sub tank 30, as shown in FIG. 3.

Then, the printing process is resumed (S230). The print head 1, carriage driving mechanism 6 and the paper feeding mechanism 14 are controlled so that the carriage 4 is moved back into the printing area, and ink is discharged from the print head 1 in accordance with the printing data.

After the printing process is resumed, the determination of whether or not the printing has completed is carried out (S240). If printing has not completed ("NO" in S240), the processes of step S130 through step S240 are repeated. During the repetition of the aforementioned steps, the preliminary ink discharge is carried out if the disconnection time exceeds a predetermined time limit ("NO" in S130). In such a case, the pump 46 is driven in order to discharge ink from the main tank 32, and washes away the impurities adhering inside the supply nozzle 34 prior to the replenishment process of S190.

Furthermore, if it is determined that ink replenishment to the sub tank 30 is necessary ("YES" in S140) during printing, before connecting the supply nozzle 34 with the sub tank 30, the impurities within the supply nozzle 34 are washed out with the preliminary discharge in the process of step S150. Hence, the transfer of such impurities into the sub tank 30 can be prevented. The sub tank 30 and the print head 1 will not be contaminated.

On the other hand, if it is determined during step S240 that the printing process is complete ("YES" in S240), the pump mechanism 42 is controlled to execute preliminary discharge (S250). Air is driven into the main tank 32 by the pump 46, and the ink from the main tank 32 is preliminarily discharged from the supply nozzle 34. During the process of step S250, the carriage 4 is within the printing area, and not within the ink supply area.

As in the case of step S160, before connecting the supply nozzle 34 with the sub tank 30, the impurities within the supply nozzle 34 are washed out with the preliminary ink discharge in the process of step S250. Hence, the transfer of such impurities into the sub tank 30 can be prevented. The sub tank 30 and the print head 1 will not be contaminated.

Step S250 and S260 are simultaneously executed. That is, the carriage driving mechanism 6 is controlled in order to move the carriage 4 to the supply position within the ink supply area during the preliminary ink discharge of step S250. Simultaneously, the cap 26 is moved from the stand-by position to the sealing position. Then, the connecting mechanism 36 is controlled in order to drive the motor 38 to connect the supply nozzle 34 and the sub tank 30 (S270). The supply nozzle 34 is moved downward, and, as shown in FIG. 2, the sub tank 30 that is now at the ink supply position within the ink supply area, is connected with the supply nozzle 34.

After the sub tank 30 and the supply nozzle 34 are connected, the pump mechanism 42 is controlled in order to drive the pump 46 to replenish ink (S280). Air is driven into the main tank 32, and, as shown in FIG. 6, the air driven into the main tank 32 forces the ink therein to be discharged via the supply nozzle 34, and the sub tank 30 is replenished with ink.

Then, it is determined if the sub tank 30 has been replenished with the necessary amount of ink (S290). If the sub tank 30 has not yet been replenished sufficiently ("NO" in S290), the process of step S280 is continued and the pump 46 is driven until the sub tank 30 is replenished with the necessary amount of ink.

When the sub tank 30 has been replenished with the necessary amount of ink ("YES" in S290), the driving of the pump 46 is ceased (S300). The controller 50 returns to the process of step S100, and again determines if printing signal is input, while the ink jet printer 100 maintains its stand-by status.

In the stand-by condition until the printing data is input, the supply nozzle 34 is pierced through the seal member 40 of the sub tank 30, and the supply nozzle 34 and the sub tank 30 are maintained connected. Such configuration prevents the supply nozzle 34 to be exposed to air. The drying of ink inside the supply nozzle 34 can be effectively prevented during the stand-by status. Then, if printing data is input ("YES" in S100), the whole cycle of steps S110 to S300 is repeated.

In the present embodiment, when performing the preliminary ink discharge from the supply nozzle 34 by carrying out the steps S135 and S150, the carriage 4 is printing in the printing area. Furthermore, when performing the preliminary ink discharge from the supply nozzle 34 by carrying out either of the step S250, the printing process had just been completed, so the carriage 4 is still in the printing area. That is, in either of the cases mentioned above, the preliminary ink discharge from the supply nozzle 34 is carried out at a timing before the carriage 4 arrives at the ink supply position. In this configuration, it is possible to replenish ink to the sub tank 30 just after the carriage arrives at the ink supply position. Therefore, a reduction in the time required for replenishing ink to the sub tank 30 is achieved.

In the present embodiment, the foam 48 is utilized for receiving ink discharged in steps S135, S150, S250. The foam 48 is also utilized for receiving ink discharged by the print head 1 in flushing process. The configuration of the ink jet printer 100 can be simplified.

Furthermore, in the present embodiment, the supply nozzle 34 and the sub tank 30 are connected during stand-by status. However, the configuration of the supply nozzle 34 and the sub tank 30 during stand-by status is not restricted to the aforementioned state. For example, the supply nozzle 34 and the sub tank 30 can be disconnected during stand-by status, and a nozzle cap not shown in the figures may cover and seal the supply nozzle 34.

Furthermore, in the aforementioned embodiment, the supply nozzle 34 is moved by the connecting mechanism 36. However, the method of connecting the supply nozzle 34 and the sub tank 30 is not restricted to the aforementioned configuration. The supply nozzle 34 can be configured so that they can be connected to the sub tank 30 without the supply nozzle 34 having to move.

Figure 9:
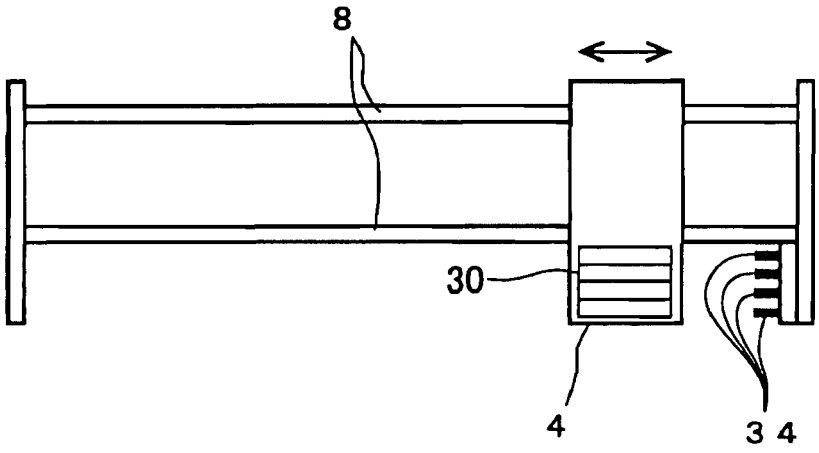
FIG. 9 shows a variant of the ink jet printer.

FIG. 9 shows a schematic view of a variant of the ink jet printer 100. As shown in FIG. 9, each of the supply nozzle 34 is arranged in the parallel direction with respect to the moving direction of the carriage 4. When the carriage reaches the ink supply area, that is, an area where the supply nozzle 34 is arranged, the supply nozzle 34 can be connected to the sub tank 30. With such a configuration, the connecting mechanism 36 of the aforementioned embodiment can be abbreviated. The connection and the disconnection of the sub tank 30 and the supply nozzle 34 can be controlled, by adjusting the position to which the carriage 4 is stopped in the ink supply area.

Figure 10:
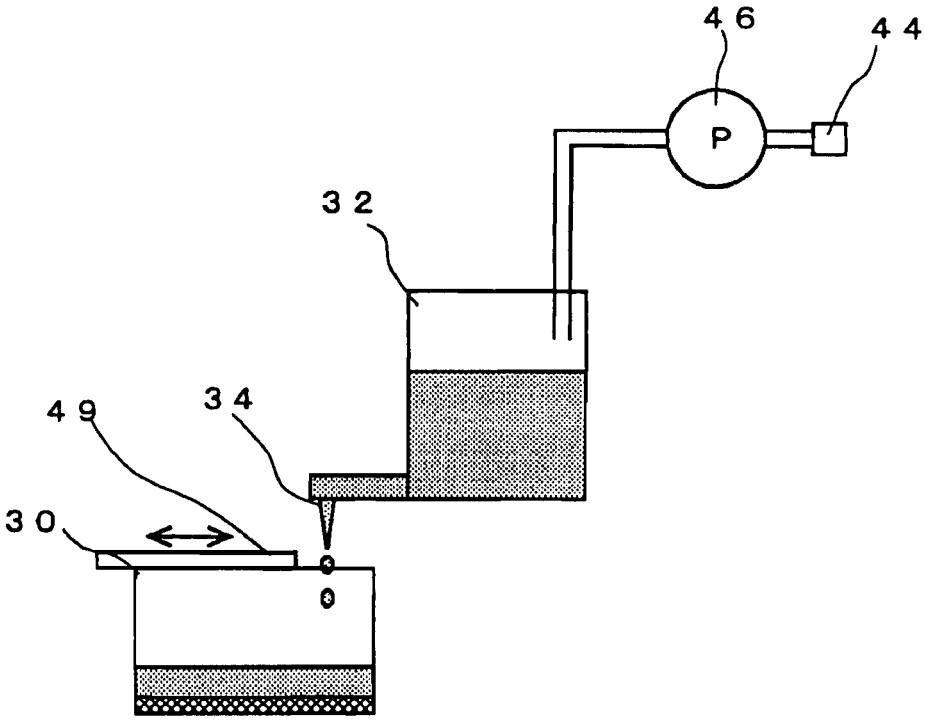
FIG. 10 shows a variant of the ink jet printer.

FIG. 10 shows a schematic view of another variant of the ink jet printer 100. As shown in FIG. 10, a cover 49 is arranged on the sub tank 30. The cover 49 slides in the direction shown with an arrow to open and close the connecting hole (not shown) of the sub tank 30. The cover 49 can be driven by a drive source (not shown), or can be moved in accordance with the movement of the carriage 4. With such a configuration, the cover 49 can be opened when the carriage 4 comes to the ink supply position within the ink supply area.

In such a case, the supply nozzle 34 can be arranged so as to be located above the opening of the cover 49 when the carriage 4 stops at the ink supply position. The ink discharged from the supply nozzle 34 can be replenished into the sub tank 30 via the opening.

Figure 11:
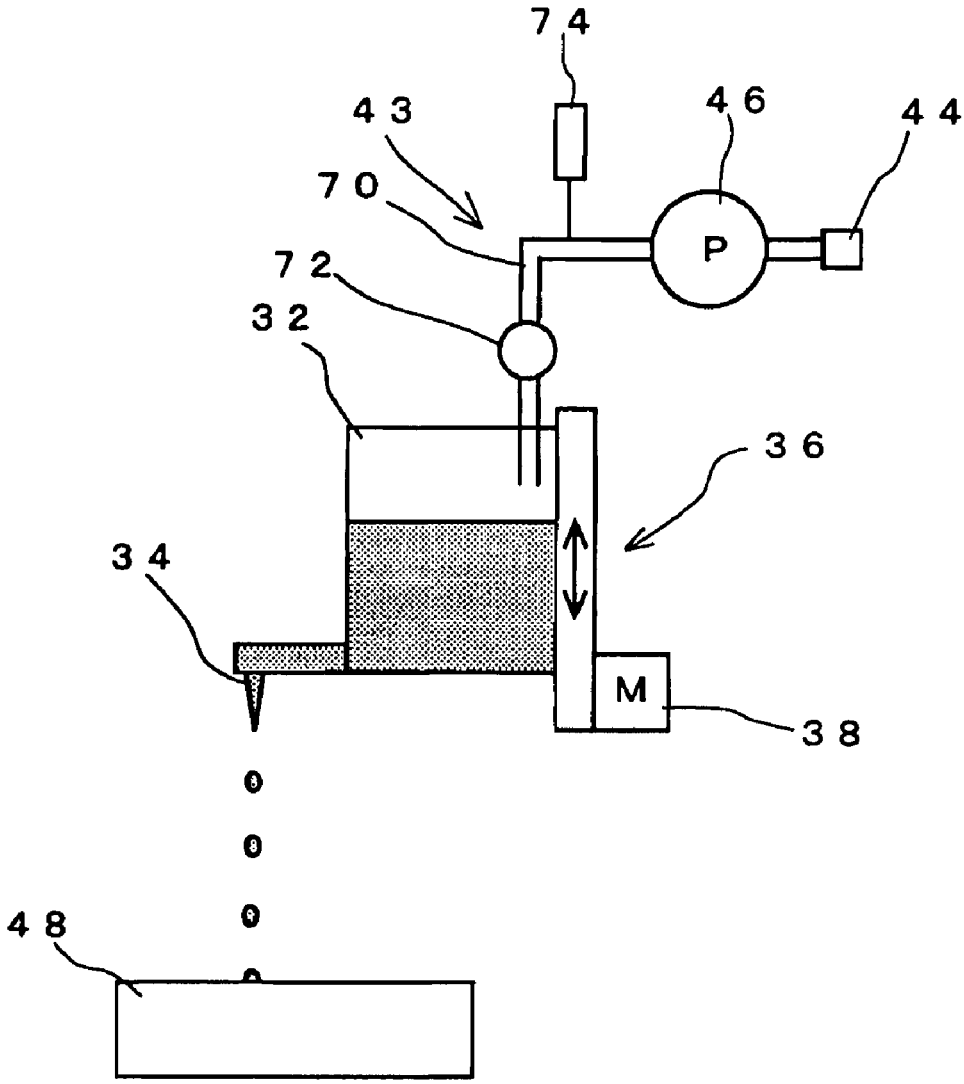
FIG. 11 shows a variant of the ink jet printer.

FIG. 11 shows a schematic view of another variant of the ink jet printer 100. As shown in FIG. 11, the pump mechanism 43 has a valve 72 that is arranged at an air passage 70 between the pump 46 and the main tank 32. Furthermore, a pressure sensor 74 is arranged at the air passage 70 to detect the air pressure of the air passage 70.

Figure 8A:
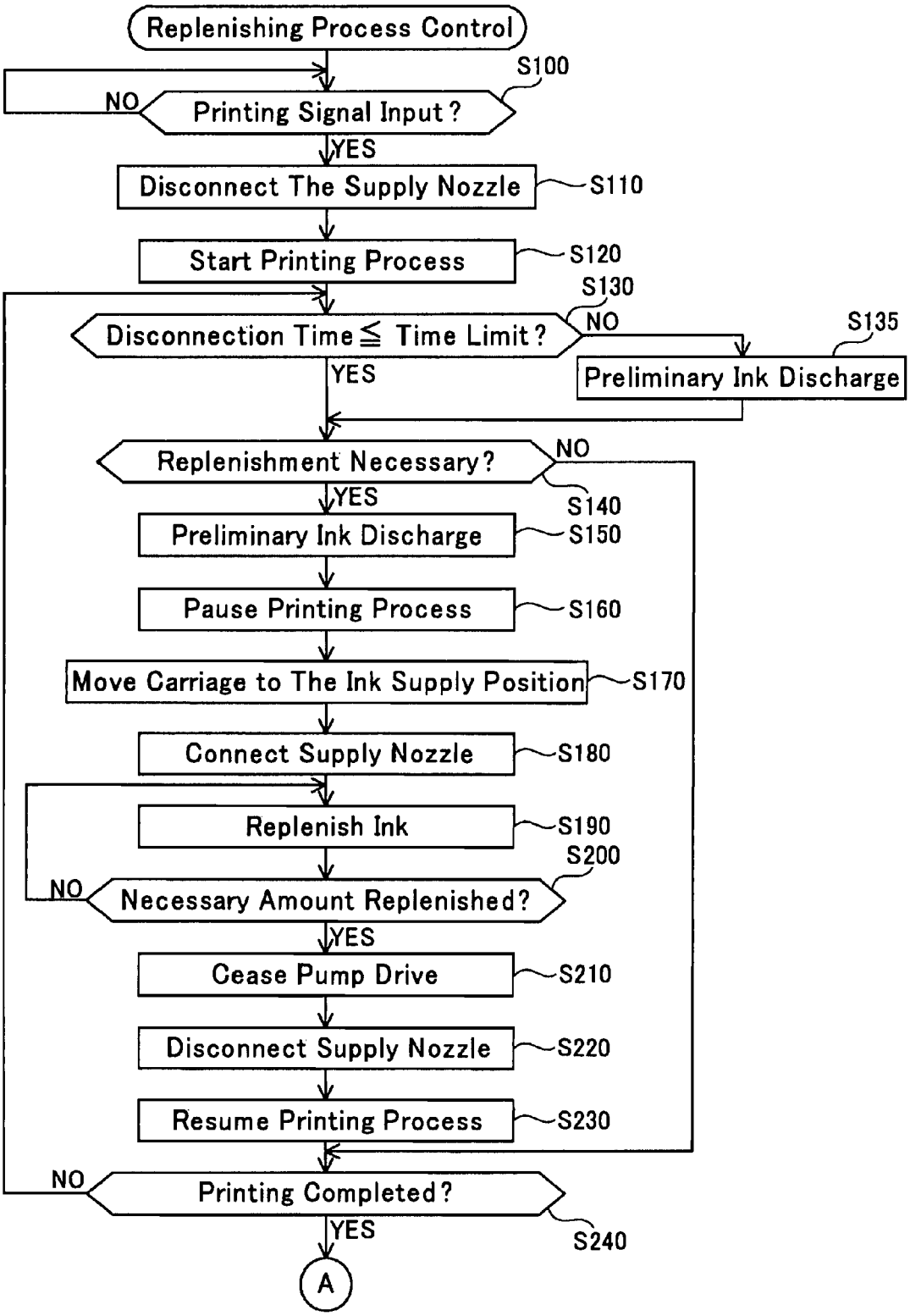
FIG. 8A and FIG. 8B show a flow chart of a replenishing process.
Figure 8B:
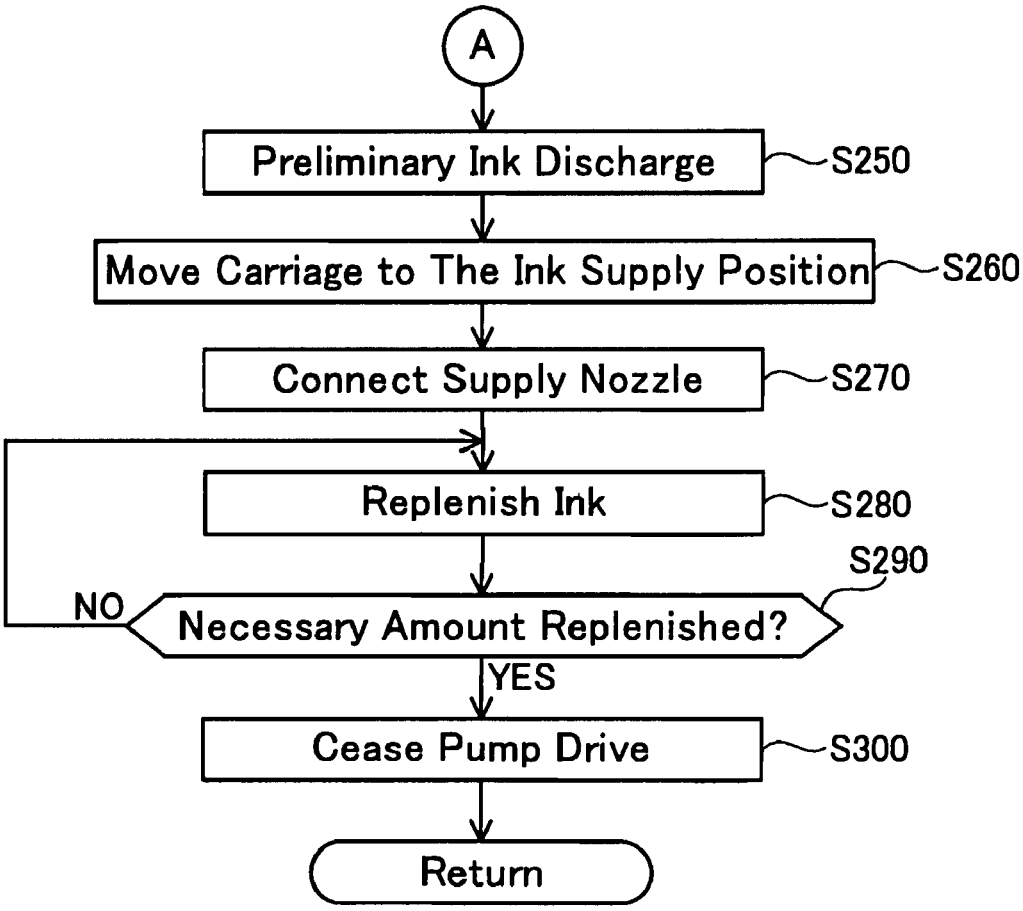

When a preliminary ink discharge is performed by the execution of one of the steps S135, S150 or S250 of the replenishing process shown in FIGS. 8A and 8B, the valve 72 is kept closed as the pump 46 is driven, and the air pressure of the air passage 70 is increased to a predetermined pressure. Change in air pressure in the air passage 70 is detected by the pressure sensor 74, and when it reaches the predetermined pressure, the valve 72 is opened, and the compressed air is driven into the main tank 32.

The compressed air forces the ink inside the main tank 32 to forcefully discharge via the supply nozzle 34, and the impurities inside the supply nozzle 34 can be washed out effectively.

Furthermore, when driving the pump 46 in the processes of steps S190 and S280, the valve 72 is opened as the pump 46 is driven. The air provided into the main tank 32 is not compressed, thus, the meniscus of the discharge nozzle of the print head 1 is maintained.

Figure 12:
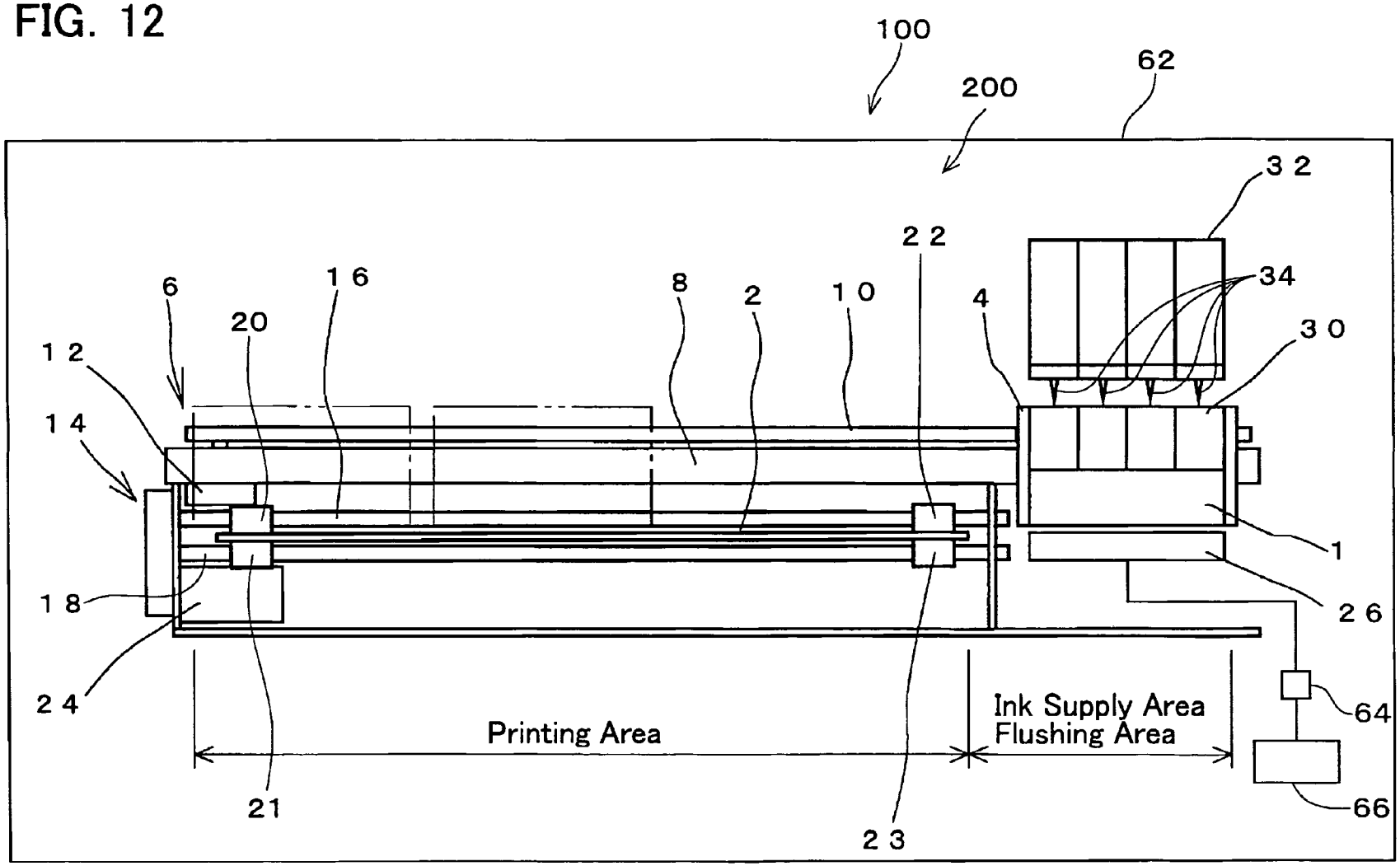
FIG. 12 shows a variant of the ink jet printer.

FIG. 12 shows a schematic view of another variant of the ink jet printer 100. As shown in FIG. 12, the cap 26 is communicated with an ink waste tank 66. Between the cap 26 and the ink waste tank 66, a vacuum pump 64 is arranged. The ink that is received with the cap 26 is vacuumed by the pressure exerted from the vacuum pump 64, and is drawn into the waste ink tank 66. The cap 26 is capable of receiving ink discharged in steps S135, S150, S250. Furthermore, the cap 26 is used to cover the nozzle surface of the print head 1. In this state, the vacuum pump 64 vacuums ink within the print head 1. The ink vacuumed by the vacuum pump 64 from the print head 1 is received by the cap 26 and is sent to the ink waste tank 66.

In the embodiment as described above, sheets of paper are assumed as the printing medium 2. However, the printing medium 2 is not restricted to such medium. The printing medium 2 may be a glass substrate, a silicon substrate, resin film, or the like. In such cases, corresponding change in the construction of the paper feeding mechanism 14 is required.

Furthermore, the printing medium 2 may have a curved surface, instead of a flat surface as is described in the embodiment above.

Moreover, in the embodiment as described above, the present invention is applied to an ink jet printer which discharges ink to print images onto the printing medium 2. However, the present invention can be adequately applied to other liquid discharge devices that discharges liquids other than ink, for example, reagent liquid, biological solution, electrical wiring material solution, electronic material solution, adhesive solution, resinous liquid for geometric molding, or the like.

What is claimed is:

1. A liquid discharge device, comprising:

a casing comprising a space for housing a main tank;

a carriage capable of moving;

a discharge head arranged on the carriage;

a sub tank arranged on the carriage, the sub tank communicating with the discharge head, wherein the sub tank is connected with the main tank when the carriage is located at a predetermined position, and the sub tank is disconnected with the main tank when the carriage is located at positions other than the predetermined position;

an energy supply device that supplies energy to liquid within the main tank such that the liquid within the main tank is discharged; and a controller that controls the energy supply device such that the liquid within the main tank is supplied to the sub tank when the carriage is located at the predetermined position, wherein the controller controls the energy supply device such that the liquid within the main tank is discharged before the carriage arrives at the predetermined position.

2. The liquid discharge device as in claim 1, wherein, in a case where a predetermined time period has elapsed since the sub tank is disconnected with the main tank, the controller controls the energy supply device such that the liquid within the main tank is discharged before the carriage arrives at the predetermined position.

3. The liquid discharge device as in claim 1, wherein, in a case where liquid within the sub tank is less than a predetermined amount during discharging motion, the controller controls the energy supply device such that the liquid within the main tank is discharged before the carriage arrives at the predetermined position.

4. The liquid discharge device as in claim 1, wherein, in a case where discharging motion is completed, the controller controls the energy supply device such that the liquid within the main tank is discharged before the carriage arrives at the predetermined position.

5. The liquid discharge device as in claim 1, wherein the controller controls the energy supply device such that the liquid within the main tank is discharged during discharging motion before the carriage arrives at the predetermined position.

6. The liquid discharge device as in claim 1, wherein the controller controls the energy supply device such that the liquid within the main tank is discharged while the carriage moves back to the predetermined position before the carriage arrives at the predetermined position.

7. The liquid discharge device as in claim 1, further comprising:

a liquid receiving member that receives the liquid discharged from the main tank before the carriage arrives at the predetermined position.

8. The liquid discharge device as in claim 7, wherein, the liquid receiving member receives the liquid discharged from the discharge head in a case where the carriage is located at the predetermined position.

9. The liquid discharge device as in claim 7, further comprising:

an liquid tank communicated with the liquid receiving member; and a vacuuming device connected with the liquid receiving member, the vacuuming device capable of vacuuming the liquid received by the liquid receiving member and sending the liquid to the liquid tank.

10. The liquid discharge device as in claim 9, wherein the liquid receiving member is capable of covering a nozzle surface of the discharge head, and the vacuuming device is capable of vacuuming liquid within the discharge head in a state where the liquid receiving member covers the nozzle surface of the discharge head.

11. The liquid discharge device as in claim 1, wherein the energy supply device is a pump connected with the main tank.

12. The liquid discharge device as in claim 1, further comprising:

a supply nozzle to be communicated with the main tank, wherein the supply nozzle pierces through the sub tank and is inserted into the sub tank when the carriage is located at the predetermined position.

13. The liquid discharge device as in claim 1, wherein the liquid discharge device is an ink jet printer, and the liquid is ink.

14. A liquid discharge device, comprising:

a casing comprising a space for housing a main tank;

a carriage capable of moving;

a discharge head arranged on the carriage;

a sub tank arranged on the carriage, the sub tank communicating with the discharge head, wherein the sub tank is connected with the main tank when the carriage is located at a predetermined position, and the sub tank is disconnected with the main tank when the carriage is located at positions other than the predetermined position;

an energy supply device that supplies energy to liquid within the main tank such that the liquid within the main tank is discharged; and a controller that controls the energy supply device such that the liquid within the main tank is supplied to the sub tank when the carriage is located at the predetermined position, wherein the controller controls the energy supply device such that the liquid within the main tank is discharged between a timing at which the carriage moves from the predetermined position and a timing at which the carriage arrives at the predetermined position.

15. A liquid discharge device, comprising:

a casing comprising a space for housing a main tank;

a carriage capable of moving;

a discharge head arranged on the carriage;

a sub tank arranged on the carriage, the sub tank communicating with the discharge head, wherein the sub tank is connected with the main tank when the carriage is located at a predetermined position, and the sub tank is disconnected with the main tank when the carriage is located at positions other than the predetermined position;

an energy supply device that supplies energy to liquid within the main tank such that the liquid within the main tank is discharged; and a controller that controls the energy supply device such that the liquid within the main tank is supplied to the sub tank when the carriage is located at the predetermined position, wherein the controller controls the energy supply device such that the liquid within the main tank is discharged when the carriage is located at a position other than the predetermined position.

* * * * *